United States Patent [19]

Wolf

[11] 4,066,192

[45] Jan. 3, 1978

[54] DISPLAY FORM FOR PANTS

[76] Inventor: Morris A. Wolf, 7048 Macapo Drive, Los Angeles, Calif. 90068

[21] Appl. No.: 749,528

[22] Filed: Dec. 10, 1976

[51] Int. Cl.[2] ..... D06C 15/00

[52] U.S. Cl. ..... 223/72

[58] Field of Search ..... 223/61, 63, 65, 72–74

[56] References Cited

U.S. PATENT DOCUMENTS

| | | | |
|---|---|---|---|
| 3,319,848 | 5/1967 | Wolf | 223/72 |
| 3,713,567 | 1/1973 | Paris | 223/73 |
| 3,811,607 | 5/1974 | Glaze | 223/74 |

*Primary Examiner*—George V. Larkin

[57] ABSTRACT

A display form having two elongated, three-dimensionally contoured leg-and-hip simulating members for insertion in the legs of a pair of pants, with flexible crease-holding wires extending along the front and back edges of each member, the wires being adjustably mounted on the members to fill out the legs of the pants and hold them taut across the contour of the members. The members are identical moldings having sockets in their adjacent sides near their hip-simulating ends, and are rotatably joined together by a junction block having part-spherical surfaces fitting into the sockets. The members are releasably clamped against the junction block in different angular relations, and the form has mounting sockets in its opposite ends facilitating support of the form in either a normal position or an inverted position.

12 Claims, 6 Drawing Figures

DISPLAY FORM FOR PANTS

BACKGROUND OF THE INVENTION

This invention relates to forms for displaying pants, and more particularly, to display forms which give pants a three-dimensional shape.

In the retail clothing business, eye-catching and attractive displays of merchandise in store windows and other places of high visibility are an important sales tool. The display should have an inviting and unusual visual effect, but at the same time it should suggest the appearance of the merchandise in actual use, and should provide a full view of the merchandise if possible.

Since displays of this type are changed frequently, often by retail personnel with little training in the use and rigging of displays, the display forms should be of a simple design that is quickly and easily set up and arranged. It is highly desirable that the forms be adjustable to accommodate merchandise of various sizes and styles so that extensive tailoring is not necessary each time a display is changed and so that the forms are not quickly rendered obsolete by styling changes.

Pants present some of the more difficult problems with respect to garment displays. They are often displayed on mannequins, but custom tailoring may be required to provide an attractive and proper fit. Moreover, the display of pants on mannequins does not readily lend itself to eye-catching and imaginative arrangements.

Another common approach to the display of pants is to simply drape them on a shelf or pedestal, usually adjacent to a coat displayed on a form. This technique, however, attracts little attention to the pants, which are not fully visible, and gives little feeling for their appearance when worn.

A principal objective of the present invention is to provide a display form for pants which gives them a life-like, three-dimensional appearance, is capable of showing them as worn and in action, and is easily and quickly adjusted to to fill out and properly shape pants of varying sizes and styles.

SUMMARY OF THE INVENTION

The invention provides a display form for pants in which the legs of the pants are supported on three-dimensional leg-and-hip simulating members, and are quickly and easily shaped and filled out by adjustable wires that hold them taut, in a neat and trim appearance. These members are also angularly adjustable, can be manufactured in a relatively economical manner and are easily positioned in different action-simulating poses. Pants thus can be displayed in an eye-catching manner in which they are fully visible and properly and attractively shaped.

Resiliently flexible wires extend along the front and back "crease" edges of each member, each wire being adjustably positioned relative to the corresponding member so that the spacing between the wire and the member can be varied. Thus, a pair of pants can be placed over the form and the position of the wires adjusted to form sharp creases in the pants, filling out the pants to their tailored shape, while, at the same time, flexing to follow any taper or flare of the pant leg. Since the pants are held taut by the wires across the contour of the simulating members, the display shows the pants filled out to their best advantage, and permits a view of the entire garment. The pants can be displayed alongside a coat or shirt while taking much less vertical space than a full mannequin, and can be arranged in unusual, attention-getting positions.

To make the members angularly adjustable, part-spherical sockets are formed in their adjacent sides near their hip ends, and a junction block with part-spherical sides is clamped between the members by a releasable clamping mechanism. For economy of manufacture, the members are of identical configuration, each having a socket in each side, the sockets on the remote sides serving as recesses for the ends of the clamping mechanism. A mounting socket is provided in each end of the display form, preferably being inserted as an incident to the casting of the members to permit support of the form in a normal position or an inverted position, and an additional mounting member may be provided at either end to support the form in an inclined position.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figures 1, 2, 3, 4, 5, 6:
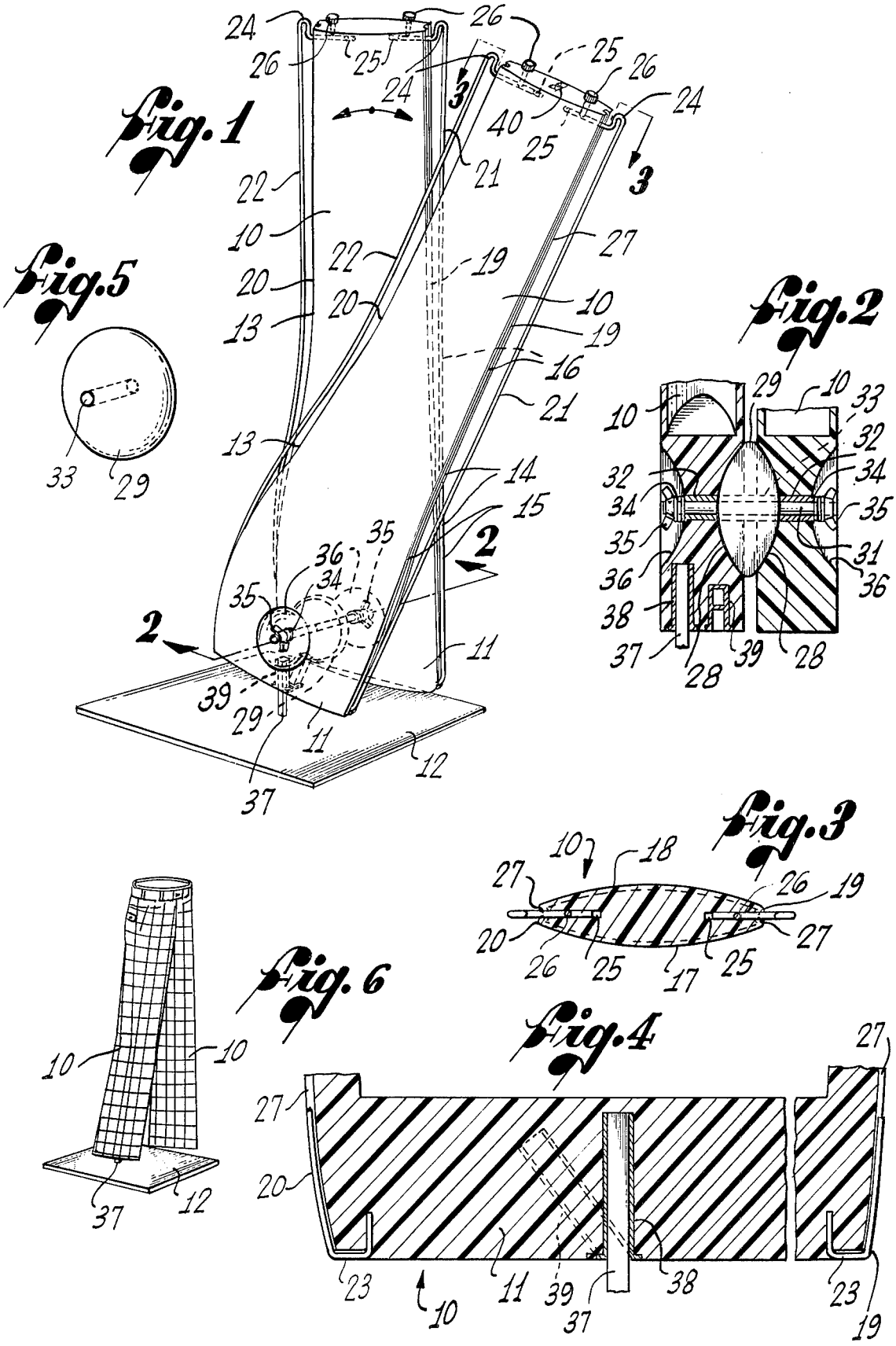
FIG. 1 is a perspective view of a display form which embodies the present invention, the form being shown in an inverted position.
FIG. 2 is a fragmentary enlarged cross-sectional view taken substantially along the line 2—2 of FIG. 1.
FIG. 3 is an enlarged cross-sectional view taken hip-simulating end of the member.
FIG. 5 is a perspective view of a junction block of the display form.
FIG. 6 is a perspective view of the display form, shown on a reduced scale in a normal position, with a pair of pants displayed thereon.

The present invention is embodied in a form for the display of pants in retail stores and the like, to attract the attention of potential customers and serve as an aid in selling merchandise. In general, the display form comprises two elongated leg-and-hip simulating members 10 which are coupled together adjacent their hip-simulating ends 11 and are three-dimensionally contoured to simulate the shape of human legs and hips in a pair of pants. The form preferably is mounted on a base 12, herein shown as a simple rectangular plate for supporting the form on a flat surface such as a floor.

As shown in FIG. 1, the form is mounted on the base in an optional inverted position, with the hip-simulating ends of the members 10 at the bottom. In FIG. 4, the form is mounted in a normal upright position and shown with an illustrative pair of pants in place. Either of these two attitudes may be selected, depending upon the wishes of the user.

More specifically, each of the members 10 has a relatively wide hip end 11, the lower end in the inverted position in FIG. 1, a convexly curved side edge portion 13 simulating the curvature of the buttocks and rear side of the upper leg, and a concave curvature simulating the rear side of the knee area. A substantially straight front edge 14 has a slight convex curvature 15 adjacent the hip end 11 and a slight concave curvature 16 from above the knee area to the opposite end, at the cuff area of the pants to be displayed. From the knee area to the cuff area, the front and rear edges are substantially parallel.

Viewed from the front or rear, the members 10 are substantially thinner than the human hip and legs, as can be seen in FIGS. 2 and 3, and preferably their side-to-side dimension in less than one half their front-to-back dimension. The side surfaces 17 and 18 are convexly curved so that the cross-sectional shape resembles an elongated ellipse, with clipped ends forming the front and rear edge surfaces 19 and 20. This general configuration fits readily into pants to be displayed and tends to extend the pants attractively in a front-to-rear direction.

In accordance with one aspect of the present invention, the members 10 are made smaller than the insides of the pants to be displayed, and an elongated and flexible expansion element is provided on at least one of the edges 19 and 20, and preferably on each of them, to fill out the pants and draw them taut on the form, while adapting to the tailored shape of the legs of the pants, thereby to display the pants to their best advantage. These expansion elements form relatively sharp and neat creases along both the front and rear of each leg, and also make it extremely simple to "rig" a display form with a pair of pants quickly and with a minimum of skill.

As shown most clearly in FIGS. 1 and 3, the illustrative expansion elements 21 and 22 are wires which extend from the cuff ends of the members along the front and rear edge surfaces 19 and 20, respectively, to the hip ends 11 of the members, and each is connected to its respective leg-and-hip simulating member at each end. At the hip ends, the expansion wires may be embedded in the member, as shown in FIG. 5, each having a reverse U-shape bend 23 extending partially across the hip end and then into the member to provide a secure anchor.

At the cuff ends of the members 10, each expansion wire has a second U-shaped bend 24 extending beyond the cuff end and then doubling back alongside the cuff end, with a laterally projecting free end portion, at a right angle to the longitudinal axis of the leg-simulating portion of the member 10, extending into a passage 25 opening out of the member through the edge surface 19, 20 thereof, as shown in FIG. 3. The laterally projecting free end portions of the expansion wires are slidably received in the passages 25, and thus are movable in and out relative to the members to shift the wires toward and away from the edge surfaces 19 and 20. To secure each wire in different selected positions, a thumb screw 26 is threaded into the cuff end of the leg to extend into the passage 25 and clamp the wire in place.

With this arrangement, it will be seen that each expansion wire 21, 22 can be shifted in a front-to-rear direction relative to the form when its clamping screw 26 is released, increasing and decreasing the effective width of the leg-simulating portions of the form as needed to fit a particular pair of pants and to stretch the legs of the pants taut on the form. Equally importantly, because the wires are longitudinally resilient and flexible, they not only fill out the pants but also adapt themselves to the tailored shape of the pants, whether that shape is flared, straight or tapered. This insures that the design features of a particular pair of pants will be effectively displayed.

It also will be seen that the expansion wires closely follow the edge contours of the leg-and-hip simulating members near the hip ends 11 thereof, and that the expansion effect is minimal in this area. The expansion effect is more important in the leg-simulating area, since the hip-simulating area can be dimensioned to substantially fill out a standard display size of pants without need for expansion, there being less overall variation in this area in different styles of pants. The front and rear edge surfaces 19 and 20 preferably are formed with longitudinal grooves 27 of semi-circular cross-section along their full lengths, to permit the wires to be recessed into the form.

Another important feature of the invention is the manner in which the leg-and-hip simulating members 10 are joined together to permit the angular movement of the members into different attitudes simulating different action poses, for the attractive display of pants. For this purpose, the members 10 are formed with part-spherical concave clamping sockets 28 in their adjacent sides near the hip-simulating ends 11, and a junction block 29, shown in FIG. 5, with part-spherical convex sides 30 is disposed between the members to form a rotational joint. To hold the members in selected relative angular positions, a simple clamping mechanism is provided to clamp the members against the junction block, which then frictionally immobilizes the members.

The clamping mechanism, as shown in FIG. 2, includes a dowel 31 that extends horizontally through openings 32 centered in the sockets 28 and an aligned central bore 33 in the junction block 29. The members 10 are pressed tightly against the junction block by two small coil springs 34 that encircle the ends of the dowel and are held in place by two wing nuts 35. So that the lay of the pants is not disturbed by the clamping mechanism, the exposed ends of the dowel, the springs and the wing nuts are contained within concave part-spherical recesses 36 on the outside surfaces of the members 10 that are of the same type and dimension as the sockets on the inside surfaces.

The leg-and-hip simulating members 10 are supported on the base 12 by a short upstanding peg 37 slidably received in a tubular mounting socket in one member. So that the members can be supported in a variety of alternative attitudes, several such sockets are provided for each member. One mounting socket 38, as shown in FIG. 4, is centrally located on the hip end 11 of the member and oriented so that it is aligned with the opposite cuff end. Another mounting socket 39 at the hip end, shown in use in FIG. 1, is inclined toward the rear edge surface 20 of the member 10. Either of the hip end mounting sockets can be used to display pants in the eye-catching inverted position.

Other mounting sockets 40 at the cuff end of each member 10 support the display in a similar manner but in a more conventional non-inverted position as shown in FIG. 4. Whatever oreintation and attitude are selected for the member supported by the peg 37, the attached member may then be clamped to it at any angle desired for the display.

According to a preferred manufacturing technique, the members 10 are formed by rotational casting to produce a hollow structure with metal inserts that form the tubular mounting sockets mounting 38 – 40 embedded in place. A particularly desirable casting material is polyurethane foam which is lightweight and economical, and will receive pins, particularly in the hip areas 11, to hold the pants in the desired shape while on display. A single mold can be used for both sides of each leg-and-hip simulating member since the members are symmetrical, with the recesses 36 being interchangable with the opposing sockets 28 that contain the clamping mechanism.

The most convenient method of placing pants on the display form of the invention is to loosen the thumb screws 26 so that the expansion wires 21, 22 can move into the position in which they are closest to the front and rear edges 19 and 20 of the members 10. The wing nuts 35 are loosened, and the members are positioned parallel to each other before the pants are placed over the members, which are then repositioned as desired. The wires 21 and 22 are expanded away from the front and back edges, of the members to form sharp creases in the pants and to stretch the pants tightly over the contour of the curved sides of the member. After this adjustment, the thumb screws 26 are tightened against the lateral projecting end of the wires to hold the wires in the positions selected.

It will be appreciated from the foregoing that the invention provides an eye-catching and versatile display for pants that is of simple construction and economical to manufacture.

While a particular form of the invention has been illustrated and described, it will be apparent that various modifications can be made without departing from the spirit and scope of the invention.

I claim:

1. A pants display form comprising a pair of three-dimensionally contoured leg-and-hip simulating members for insertion in a pair of pants and each having front and back edges, elongated, flexible expansion elements extending along the edges of said simulating members and spaced from said simulating members throughout at least a substantial portion of their lengths, and means for holding said expansion elements away from said simulating members to pull pants taut across the contours of said leg members, comprising an extension at one end of each of said expansion elements, and means for securing each of said extensions to one of said simulating members to hold said expansion elements at adjustable distances from said simulating members.

2. The display form of claim 1, further comprising clamping means for pivotably attaching said simulating members to each other so that one of said simulating members can be rotated independently of the other and secured in a selected relative angular position.

3. The display form of claim 2, wherein simulating members define recesses in which said clamping means are located.

4. The display device of claim 1, further comprising a junction block disposed between said simulating members, a dowel passing through said simulating members and said junction block and permitting rotational movement of at least one of said simulating members thereon, and means engaging said dowel for holding said simulating members against said block and in selected relative angular positions.

5. The display form of claim 4, wherein said junction block has two opposing convex sides and said simulating members have concave sockets that rotatably receive said convex sides.

6. A pants display form comprising:

a pair of leg-and-hip simulating members for insertion in a pair of pants to be displayed, each simulating member having front and back edges, three-dimentionally contoured sides, a cuff end, and a hip end;

rotational joint means for rotatably attaching said simulating members to each other so that one of said simulating members can be rotated independently of the other and secured in a selected angular position, said joint means comprising a junction block positioned between said simulating members, a dowel passing through said simulating members and said junction block and permitting rotational movement of at least one of said simulating members thereon, and means engaging said dowel for frictionally holding said simulating members in selected angular positions relative to each other;

a base on which said simulating members are supported;

four elongated, resilient, flexible, crease-forming expansion wires each of which extends along a front or back edge of one of said simulating members and is spaced therefrom throughout a substantial portion of its length;

an extension at one end of each of said expansion wires; and means for adjustably securing said extensions to said simulating members to hold said expansion wires at selected distances from said simulating members, whereby a pair of pants can be sharply creased by said wires and pulled taut across the contours of said simulating members.

7. The display form of claim 6, wherein said junction block has two opposing part-spherical convex sides, and each of said simulating members has a concave part-spherical socket that receives one of said convex sides.

8. The display form of claim 7, wherein simulating members define recesses opposite said sockets in which said clamping means are contained.

9. The display device of claim 7, further comprising support means for supporting said simulating members on said base in a selected attitude, said support means comprising a peg extending upwardly from said base and a plurality of tubular mounting sockets in said simulating members for alternatively receiving said peg.

10. A pants display form comprising a pair of leg-and-hip simulating members for insertion in a pair of pants, each of said simulating members having a hip end and a cuff end;

rotational joint means for attaching said simulating members to each other adjacent said hip ends so that one of said simulating members can be rotated relative to the other and secured in a selected angular position;

and supporting means for said display form comprising a base, a peg extending upwardly from said base, and a mounting socket in one of said simulating members at each end of said display form in which said peg is received to support said members selectively in either an upright position or an inverted position.

11. A pants display form comprising:

a pair of leg-and-hip simulating members;

rotational joint means for attaching said simulating members to each other so that one of said simulating members can be rotated relative to the other and secured in a selected angular position, said joint means including a junction block having convex sides positioned between said simulating members, concave clamping sockets formed in said simulating members in which said junction block is rotatably received, and a dowel extending horizontally through said simulating members and said junction block;

a base;

a peg projecting upwardly from said base; and a plurality of mounting sockets formed in said simulating members, said peg being received in one of said mounting sockets to support said simulating members.

12. The pants display form of claim 11, wherein each of said simulating members has a hip end and a cuff end; at least one of said mounting sockets being located at said hip end of one of said simulating members to support said simulating members in an inverted position.

* * * * *

UNITED STATES PATENT AND TRADEMARK OFFICE

CERTIFICATE OF CORRECTION

PATENT NO. : 4,066,192

DATED : January 3, 1978

INVENTOR(S) : Morris A. Wolf

It is certified that error appears in the above-identified patent and that said Letters Patent are hereby corrected as shown below:

Column 2, line 31, change figure description to read

-- FIG. 3 is an enlarged cross-sectional view taken substantially along the line 3-3 of FIG. 1; --

Column 2, line 33, insert figure description

-- FIG. 4 is an enlarged fragmentary cross-sectional view taken substantially through the center at the lower end of a leg-and-hip simulating member of the display form in FIG. 1, this being the hip-simulating end of the member;

Signed and Sealed this

Sixteenth Day of May 1978

[SEAL]

Attest:

RUTH C. MASON
Attesting Officer

LUTRELLE F. PARKER
Acting Commissioner of Patents and Trademarks